US005730433A

United States Patent [19]

Veres

[11] Patent Number: 5,730,433

[45] Date of Patent: Mar. 24, 1998

[54] BULLDOG MITER CLAMP

[76] Inventor: John Veres, 20 Roseview Dr., Calgary Ab., Canada, T2K1N7

[21] Appl. No.: 714,836

[22] Filed: Sep. 6, 1996

[30] Foreign Application Priority Data

Mar. 27, 1996 [CA] Canada ..... 2167849

[51] Int. Cl.[6] ..... B25B 1/20

[52] U.S. Cl. ..... 269/41; 269/136; 269/134; 269/246; 269/240

[58] Field of Search ..... 269/41, 105, 104, 269/154, 155, 152, 246, 240, 268, 37, 44, 136, 134, 249

[56] References Cited

U.S. PATENT DOCUMENTS

| | | | |
|---|---|---|---|
| 575,909 | 1/1897 | Schuler et al. | 269/104 |
| 1,730,510 | 10/1929 | Jensen | 269/134 |
| 2,773,303 | 12/1956 | Tirone | 269/152 |
| 2,991,669 | 7/1961 | Stock | 269/152 |
| 3,837,060 | 9/1974 | Stehling | 269/152 |
| 4,111,180 | 9/1978 | Goodrich | 269/246 |
| 4,995,935 | 2/1991 | Ganzberger | 269/41 |
| 5,174,004 | 12/1992 | King et al. | 269/155 |

*Primary Examiner*—Timothy V. Eley
*Assistant Examiner*—Lee Wilson

[57] ABSTRACT

A tool for mating, clamping, and gluing under high pressure, two picture frame members, the ends of which have been precisely cut prior to clamping. This high pressure produces a stronger joint than is now available in existing clamps that only hold the adjacent times while the glue is setting. It also produces a faster glue setting time than conventional clamps since excess glue is squeezed out, thus increasing clamp efficiency by making it available sooner for the next glue joint. In addition, it embodies an optional vertical clamp, which, in conjunction with a transparent triangular plate, applies a vertical pressure on members that may have been slightly warped or inaccurately cut. The triangular plate is optionally used with complex profiles to distribute the pressure. This combination results in a tight aesthetic joint. Existing clamps on the market do not embody this feature.

4 Claims, 3 Drawing Sheets

BULLDOG MITER CLAMP

BACKGROUND OF THE INVENTION a) Field of the Invention

This small, manually-operated, portable tool or device is a miter clamp that was invented or developed primarily for application in the art and framing industry. It may be used for framing or mirrors, etc.

b) Description of the Prior Art

There are several varieties of manually-operated miter clamps presently on the market. They all operate on the same common principal, i.e. each adjacent frame member is independently and firmly glued and clamped in proper relation to each other by two separate controls operating on a common base. Very little compressive pressure is applied to the mating members and the glue joint. Their primary function is to hold the mating surfaces and prevent separation while the glue sets. Clamps now on the market do not have a vertical clamping feature as well as other features which will become more apparent later.

SUMMARY OF THE INVENTION

The purpose of this invention was to design a simpler manually-operated, more efficient miter clamp which may not only hold the frame members, but will also apply a high compressive force on the glue joint, forcing the glue into the fibers of the members which will result in a stronger glue joint. It will also force the mating surfaces closer together, squeeze out the excessive glue, allowing it to set faster, and the clamp can then be sooner released for the next joint. This invention has a vertical clamp which can be used in conjunction with a small transparent plexiglass triangle to protect the aesthetic surfaces of the frames and close any joint gap that may have resulted from an inaccurate cut or warped frame.

DESCRIPTION OF THE PREFERRED EMBODIMENTS

Figure 1:
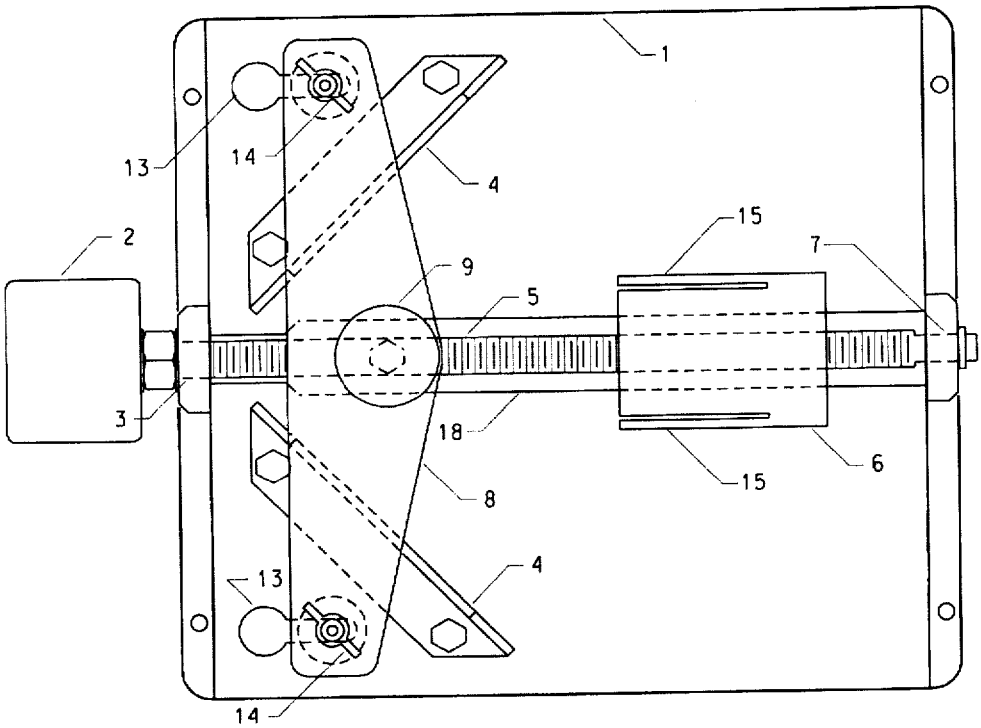
FIG. 1 is a plan view of the apparatus.

The invention mainly comprises a table base having a screw slot and two adjustable slots; a horizontal drive rod mounted to said table base and extending along said screw slot; an horizontal drive knob attached to one end of said horizontal drive rod for rotating said rod; a slider threadedly mounted in said screw slot to said horizontal drive rod for movement by said horizontal drive rod through said screw slot, said slider having prongs there for engagement with said picture frame members; two 90 degree picture frame stops, one being mounted on either side of said horizontal drive rod for cooperating with said slider by holding said picture frame members between said stops and said slider; two support pedestals, each being adjustably mounted to the table base in a respective one of said adjustable slots; a support plate mounted above the base table to a top of each support pedestal; a vertical clamp assembly attached to the support plate and located above said horizontal drive rod, the vertical clamp assembly including a vertical drive rod having a vertical knob attached thereto for rotating said vertical drive rod, and a padded swivel foot attached to a bottom of the vertical drive rod for holding a top of said picture frame members.

Referring to the drawings, the invention will be explained in more detail.

Figure 2:
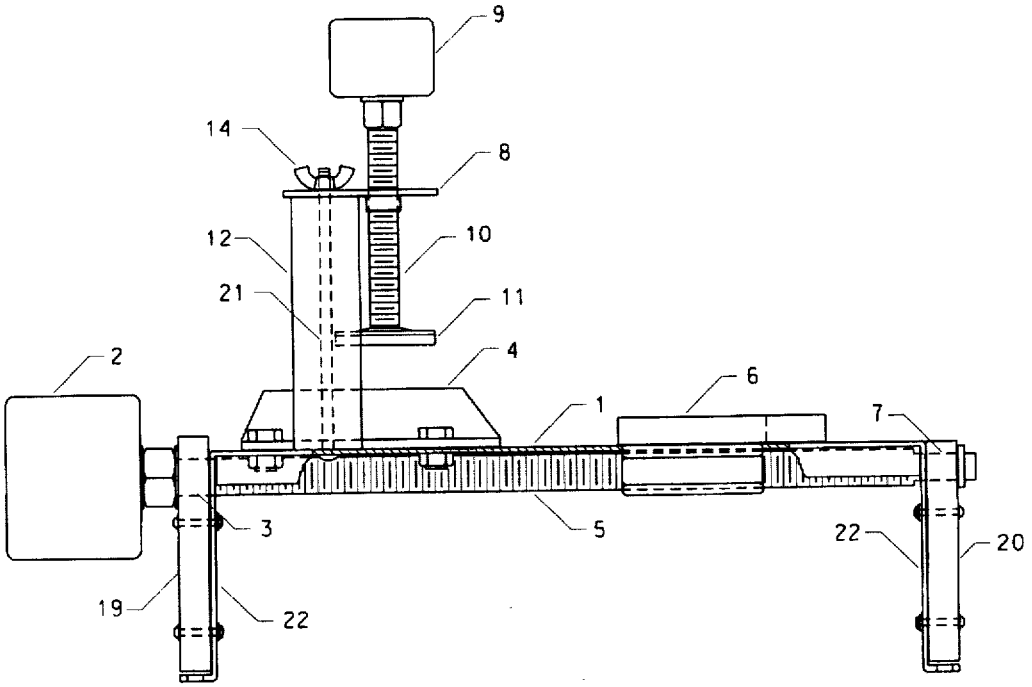
FIG. 2 is a side elevation of the apparatus.
Figure 3:
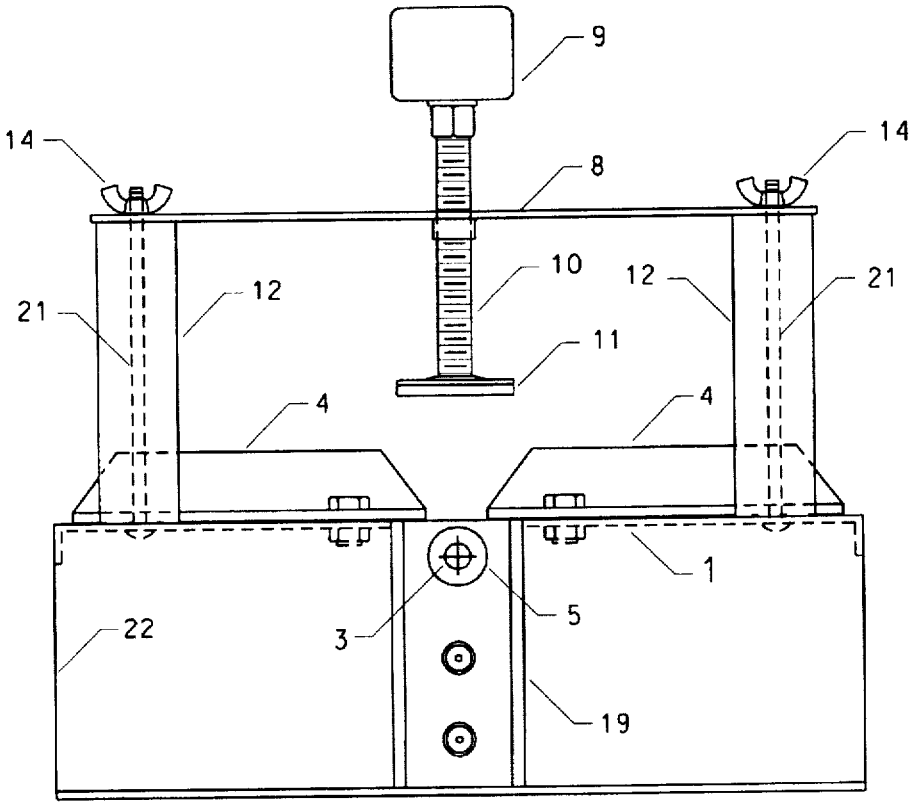
FIG. 3 is a front elevation of the apparatus.
Figure 4:
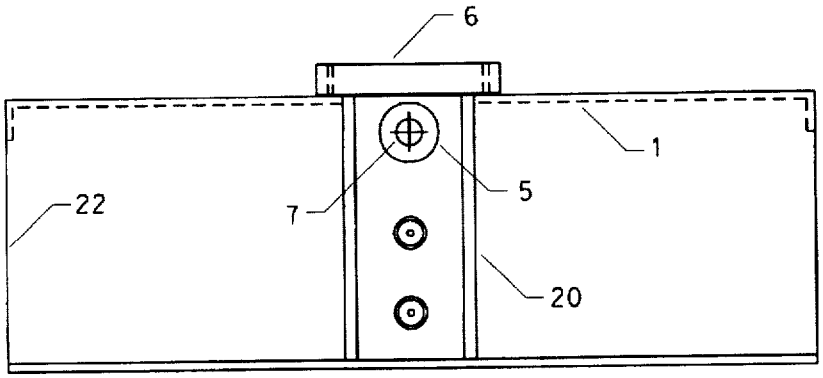
FIG. 4 a rear elevation of the apparatus.

As seen in FIGS. 1–4, a manually operated clamping tool comprises a table base 1 with a horizontal drive rod slot 18; two adjustable slots 13 for support pedestals 12 with bolts 21; a horizontal drive rod 5 with front bearing 3 and rear bearings 7; an horizontal drive knob 2; a slider 6 with prongs 15; and two 90 degree picture frame stops 4. The vertical clamp assembly has a vertical knob 9, a vertical drive rod 10, and a padded swivel foot which is attached to a support plate 8 that is supported by the support pedestals 12 above the base table 1. The support plate 8 holds the vertical clamp which is attached to the support pedestals 12 by two wing nuts 14 and the whole assembly is attached to the table base 1 by the adjustable slots 13. The table base as shown in FIG. 2 has u-shaped legs 22 which have the front bearing plates 19 and rear bearing plates 20 (as shown in FIG. 4) attached.

Figure 5:
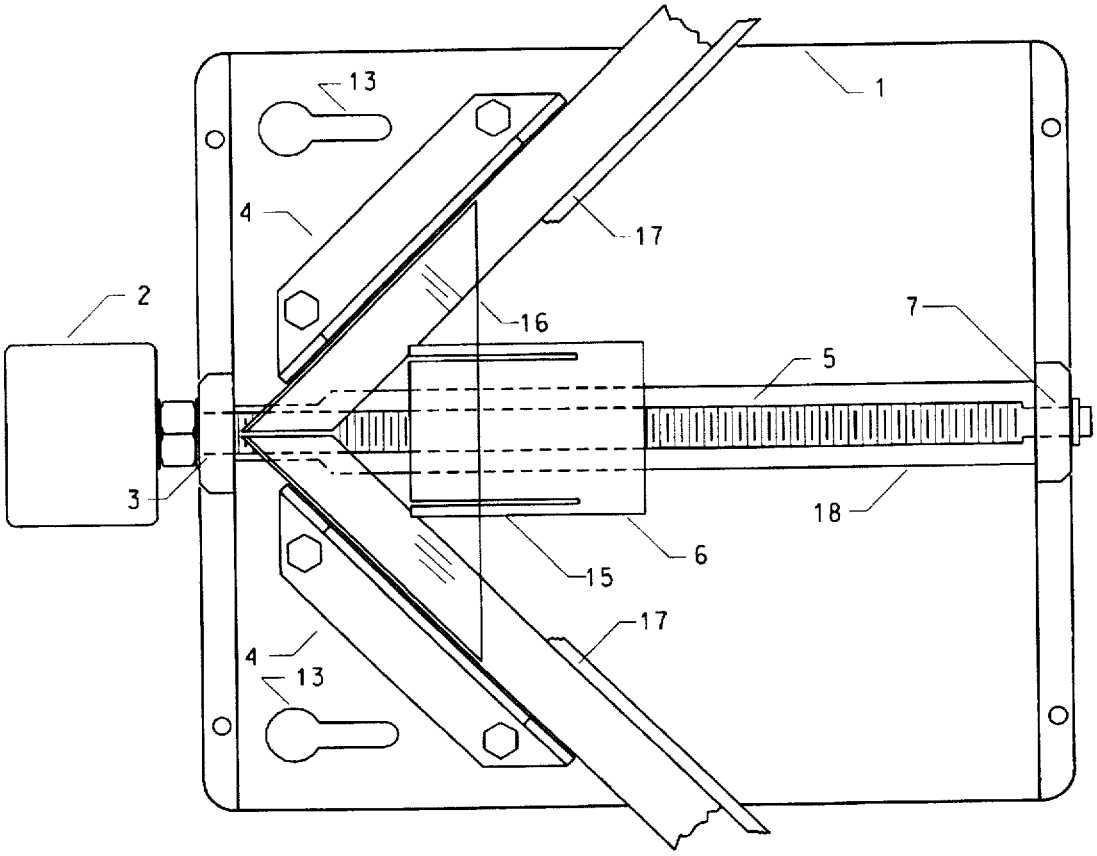
FIG. 5 a plan view of the apparatus showing the picture frame.

Referring to FIG. 5, a manually operated clamping tool is shown with a picture frame member 17, a plexiplate triangle, and a manually operated clamp without the vertical clamp assembly being attached.

In operation, glue must first be applied to the mating faces of the picture frame members (FIG. 5), then held against the picture frame stop. The two mating face of the joint must first be aligned and held together by hand, then the horizontal drive knob (FIG. 1) is rotated clockwise to advance the slider towards the picture frame members and further rotation of the drive knob will deflect the prongs inward toward the glue joint. This deflection applies a 45 degree component of force parallel to the 90 degree picture frame stops. The amount of pressure on the glue joint is controlled by the rotational force on the drive knob. A pressure of up to 100 lbs can be applied by the horizontal drive knob.

The vertical drive knob (FIG. 2) may be used for complex picture frames profiles, imperfect cuts, and/or warped members where the glue joint may not fully close using the horizontal drive knob alone. Supplied with the manually operated clamping tool is a small, clear plexiplate triangle (FIG. 5) which is placed between the padded swivel foot and picture frame members. By rotating the vertical drive knob in a clockwise direction, a strong vertical pressure is applied to the picture frame members, closing the aligned glue joints and enhancing the finished product. The plexiplate triangle is only used for distributing the pressure on the frame member and to protect their aesthetic finish, particularly with frame members with complex profiles.

I claim:

1. A manually operated clamping tool for clamping and gluing two adjacent picture frame members together, the tool comprising:

a table base having a screw slot and two adjustable slots therein;

a horizontal drive rod mounted to said table base and extending along said screw slot;

an horizontal drive knob attached to one end of said horizontal drive rod for rotating said rod;

a slider threadedly mounted in said screw slot to said horizontal drive rod for movement by said horizontal drive rod through said screw slot, said slider having prongs there for engagement with said picture frame members;

two 90 degree picture frame stops, one being mounted on either side of said horizontal drive rod for cooperating with said slider by holding said picture frame members between said stops and said slider;

two support pedestals, each being adjustably mounted to the table base in a respective one of said adjustable slots;

a support plate mounted above the base table to a top of each support pedestal;

a vertical clamp assembly attached to the support plate and located above said horizontal drive rod, the vertical clamp assembly including a vertical drive rod having a vertical knob attached thereto for rotating said vertical drive rod, and a padded swivel foot attached to a bottom of the vertical drive rod for holding a top of said picture frame members.

2. The manually operated clamping tool according to claim 1 wherein the support plate is removably attached to each support pedestal by a wing nut.

3. The manually operated clamping tool according to claim 2, wherein the table base has two u-shaped legs, and an end of said horizontal drive rod is mounted to a respective one of each of said u-shaped legs by a front bearing plate and a rear bearing plate, each said bearing plate being attached to a respective one of each of said two u-shaped legs of said table base.

4. The manually operated clamping tool according to claim 2, wherein the support pedestals are slidable in a direction parallel to said horizontal drive rod.

* * * * *